US012016458B1

(12) United States Patent
Young

(10) Patent No.: US 12,016,458 B1
(45) Date of Patent: Jun. 25, 2024

(54) TEMPERATURE CONTROLLED FOLDING TABLE

(71) Applicant: Tamyra Young, Sharon Hill, PA (US)

(72) Inventor: Tamyra Young, Sharon Hill, PA (US)

( * ) Notice: Subject to any disclaimer, the term of this patent is extended or adjusted under 35 U.S.C. 154(b) by 282 days.

(21) Appl. No.: 17/585,421

(22) Filed: Jan. 26, 2022

(51) Int. Cl.
*A47B 31/04* (2006.01)
*A47B 3/083* (2006.01)
*A47B 3/12* (2006.01)
*A47B 31/02* (2006.01)

(52) U.S. Cl.
CPC ..... *A47B 31/04* (2013.01); *A47B 3/083* (2013.01); *A47B 3/12* (2013.01); *A47B 31/02* (2013.01)

(58) Field of Classification Search
CPC ..... B65D 81/3461; A47B 31/04; A47B 31/02; A47B 3/12; A47B 3/083; A47B 13/16; A47J 36/2405; A47J 36/24; A47J 27/18; A47J 27/14
See application file for complete search history.

(56) References Cited

U.S. PATENT DOCUMENTS 2,024,259 A * 12/1935 Troeber ..... A47J 36/24 126/33
3,364,882 A * 1/1968 Merrick ..... A47B 13/00 108/50.13
3,944,109 A * 3/1976 Holz ..... A47G 23/0641 220/512
4,920,873 A * 5/1990 Stevens ..... A47J 36/2405 211/49.1
5,060,580 A * 10/1991 Shaw ..... A47B 3/083 108/33
5,699,784 A * 12/1997 Tippmann ..... A47J 27/10 126/33
6,591,831 B2 * 7/2003 Reynolds ..... A47J 36/2405 108/26
6,612,124 B1 * 9/2003 Hatch ..... A47F 10/06 220/676
7,779,762 B2 * 8/2010 Sackman ..... A47B 13/081 108/38
7,922,027 B2 * 4/2011 Boyden ..... A47J 36/04 220/573.2
8,176,855 B1 * 5/2012 Cannon ..... A47B 13/16 229/117.08
8,857,346 B2 10/2014 Khanjian et al.
8,869,682 B2 * 10/2014 Tosdale ..... A47J 27/16 99/426
9,089,210 B2 * 7/2015 Kool ..... A47B 31/02
D760,035 S * 6/2016 Kim ..... D7/629
9,435,567 B2 * 9/2016 Ra ..... F24V 30/00
9,505,542 B2 * 11/2016 France ..... B65D 21/0209
9,622,571 B1 4/2017 Wassel et al.
D831,395 S 10/2018 Vargas, II et al.
10,117,513 B1 * 11/2018 Tolentino ..... A47B 31/04
10,806,250 B1 10/2020 Torre
11,819,123 B2 * 11/2023 Zhang ..... A47B 3/10
2001/0019060 A1 * 9/2001 Zank ..... A47J 27/18 220/573.1

(Continued)

*Primary Examiner* — Patrick D Hawn
(74) *Attorney, Agent, or Firm* — Cramer Patent & Design; Aaron R. Cramer

(57) ABSTRACT

A temperature controlled folding table is a traditionally configured folding table having a plurality of upper surface cut outs. Within the cut outs are a mesh like bag liner suitable for retaining ice therein thereby permitting a user to keep food chilled.

20 Claims, 5 Drawing Sheets

(56) References Cited

U.S. PATENT DOCUMENTS

| | | | | |
|---|---|---|---|---|
| 2004/0244414 | A1* | 12/2004 | Trinh | A61F 7/103<br>62/530 |
| 2007/0034200 | A1* | 2/2007 | Torre | A47J 36/2405<br>126/33 |
| 2007/0056482 | A1* | 3/2007 | Robinson | A47B 37/04<br>108/25 |
| 2011/0088974 | A1* | 4/2011 | Bond | E06C 7/14<br>182/129 |

* cited by examiner

TEMPERATURE CONTROLLED FOLDING TABLE

RELATED APPLICATIONS

Non-applicable.

FIELD OF THE INVENTION

The presently disclosed subject matter is directed to a folding table and more specifically to a temperature controlled folding table.

BACKGROUND OF THE INVENTION

Spending time in the great outdoors is among the most popular fair-weather leisure time activities. Quite often, cooking and eating a meal is made part of the outdoor activity. Whether it be camping, at a picnic or having a cookout, a great deal of time is spent preparing and consuming a meal. A typical food item often found at these gatherings is potato salad, macaroni salad, or similar food which uses mayonnaise as an ingredient. While the taste of these foods is unquestionably delicious, they must be kept cold, not only to maintain their excellent taste, but to also reduce the growth of bacteria and possible food poisoning.

These same foodstuffs are subject to the same problems during indoor events such as graduation parties, birthday parties, and holiday gatherings as they may sit out for hours during the course of a party. Similar problems exist for foods that should stay warm such as pizza, wings, casseroles, and the like. Accordingly, there exists a need for a means by which various warm and chilled foodstuffs can be maintained at their desired temperature for longer periods of time during the entire serving process in order to ensure food safety and taste. The development of the portable serving table for warm and chilled food 10 fulfills this need.

SUMMARY OF THE INVENTION

The present invention provides for a portable serving table that has a main table surface having at least 4 openings adapted to accept a plurality of food serving devices and an upper edge, at least one insulating textile bag disposed underneath each of the at least 4 openings positioned below the main table surface, a food serving dish placed in each of the at least one insulating textile bag such that the upper edge of the food serving dish is flush with an upper surface of the main table surface, a center hinge disposed on a middle portion of the main table surface, a pair of folding leg assemblies each having a pair of legs and a pair of locking braces, and a table cover covering the main table surface along a cover placement travel path. The at least one insulating textile bag includes an inner layer, an insulating layer, and an outer layer. The center hinge includes a clasp and a handle to facilitate storage and transport.

The upper edge of the food serving devices may be flush with the main table surface. A pair of the at least 4 openings may remain visible when the at least one insulating textile bag is in a compressed state. The main table surface may be 6 feet in length. The at least one insulating textile bag may allow the at least one insulating textile bag to be folded withing a cavity formed by the main table surface when the portable serving table is collapsed. The at least one insulating textile bag may be attached underneath the main table surface by a plurality of fasteners. The fasteners may be a plurality of removable screws. The removable screws may allow for the at least one insulating textile bag to be removed, washed, cleaned, or replaced. The inner layer may be selected from the group consisting of a nylon layer, a rubber layer, or a waterproof layer. The insulating layer may accept a warm temperature or a cool temperature on a first side of the insulating layer with an opposite cool temperature or a warm temperature on a second side of the insulating layer. The insulating layer may be a thermally insulating layer selected from the group consisting of a cotton layer, a spun fiber layer, or a wool layer. The outer layer may be made of a material capable of accepting repeated physical contact selected from the group consisting of a nylon material, a canvas material, or a durable material. The food serving dish may be made of a material selected from the group consisting of aluminum foil, steel, copper, glass, ceramic, or plastic. The main table surface may be folded along the center hinge into a pair of table surface halves that is secured with the clasp. The handle may be disposed on top of the main table surface. The pair of folding leg assemblies may move along a leg travel path to allow transfer from a stowed position within the main table surface to an extended position. The table cover may transform the portable serving table into a conventional folding table with a continuous surface that covers the at least 4 openings. The table cover may cover the main table surface when functionality and services of the portable serving table with the at least 4 openings are not required. The portable serving table may facilitate serving one or more chilled foodstuffs. The portable serving table may facilitate serving one or more warmed foodstuffs.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
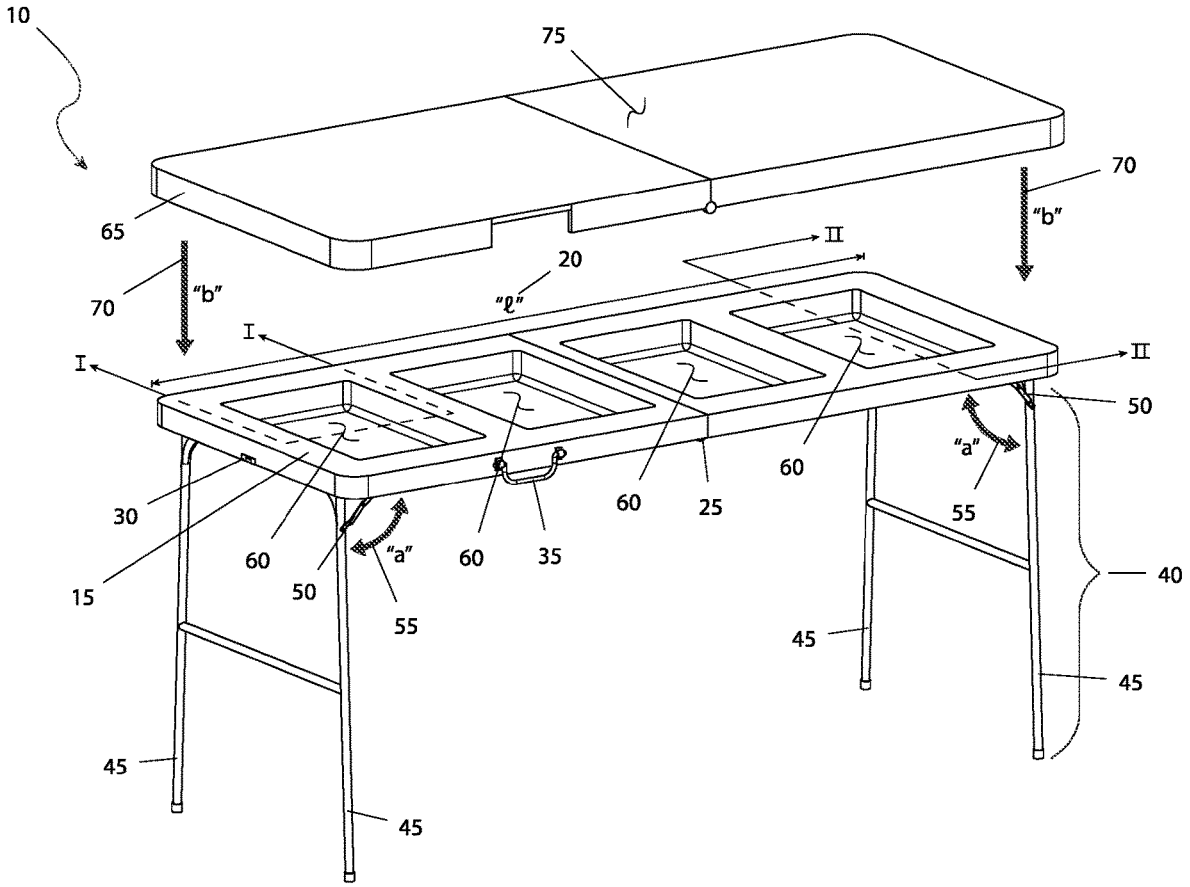
FIG. 1 is a perspective view of the portable serving table, in a deployed state, according to the preferred embodiment of the present invention.

10 portable serving table
15 main table surface
20 length "l"
25 center hinge
30 clasp
35 handle
40 folding leg assembly
45 leg
50 locking brace
55 leg travel path "a"
60 opening

65 table cover
70 cover placement travel path "b"
75 continuous surface
80 insulating textile bag
85 fastener
90 inner layer
95 insulating layer
100 outer layer
105 food serving dish
110 chilled foodstuffs
115 ice pack
120 warmed foodstuffs
125 table surface half

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a perspective view of the portable serving table 10, in a deployed state, according to the preferred embodiment of the present invention is disclosed. The portable serving table (herein also described as the "table") 10, includes enhanced features to facilitate serving chilled foodstuffs 110 or warmed foodstuffs 120. The table 10 provides for a main table surface 15 with an approximate length "l" 20 of six feet (6 ft.) and provided with a center hinge 25 along with a clasp 30 and a handle 35 to facilitate storage and transport. The table 10 is provided with two (2) folding leg assemblies 40 each consisting of two (2) legs 45 and two (2) locking braces 50. The folding leg assemblies 40 move along a leg travel path "a" 55 to allow transfer from a stowed position within the main table surface 15 to an extended position as shown in FIG. 1. The main table surface 15 is provided with at least four (4) openings 60 capable of accepting various food serving devices, such that the upper edge of the food serving devices are approximately flush with the main table surface 15. Further description of the configuration of the openings 60 will be provided herein below. Finally, a table cover 65, approximately the same size as the main table surface 15 is capable of being installed over the main table surface 15 along a cover placement travel path "b" 70. The table cover 65 provides the ability to transform the table 10 into a conventional folding table with a continuous surface 75 that covers the openings 60. The placement of the table cover 65 over the main table surface 15 would be utilized when the functionality and services of the table 10 with the openings 60 are not required.

Figure 2:
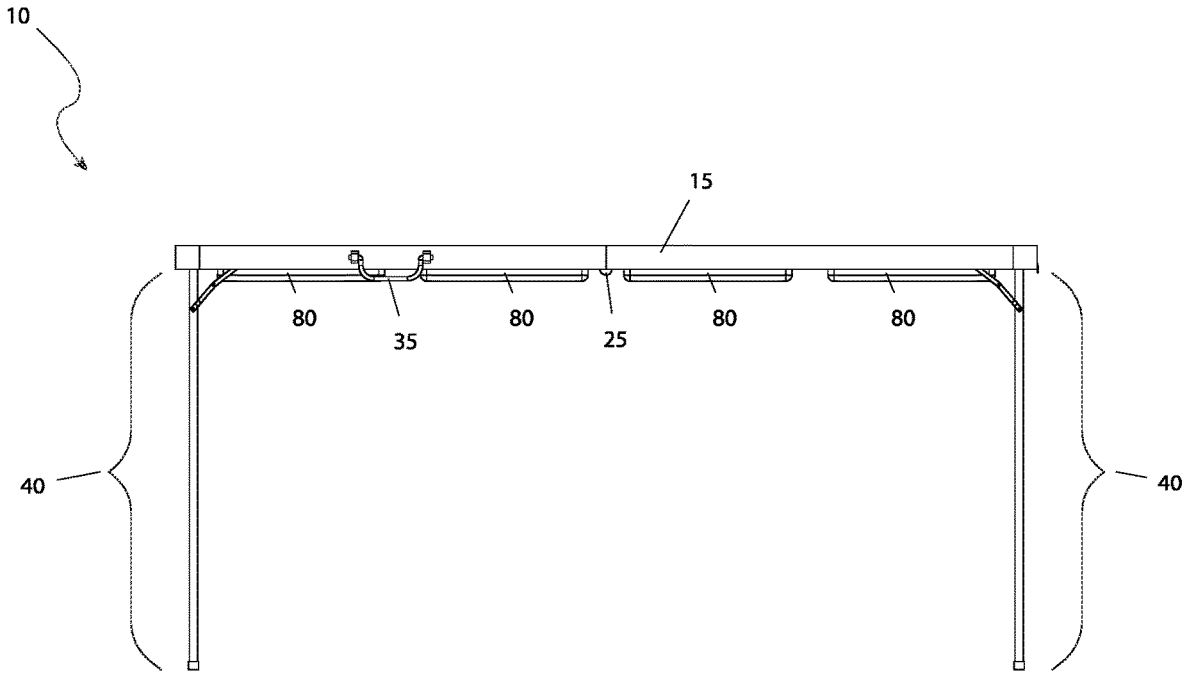
FIG. 2 is a side view of the portable serving table, according to the preferred embodiment of the present invention.

Referring next to FIG. 2, a side view of the table 10, according to the preferred embodiment of the present invention is depicted. This view provides further clarification of the placement of the center hinge 25, the handle 35 and the folding leg assemblies 40. At least one (1) insulating textile bag 80 is provided from the bottom of each opening 60 and positioned below the main table surface 15 when the table 10 is in a deployed state as shown. Further detail on the construction and configuration of the insulating textile bags 80 will be provided herein below. The foldable and collapsible nature of the insulating textile bags 80 allow the insulating textile bags 80 to be folded withing the cavity formed by the main table surface 15 when the table 10 is in a collapsed state.

Figure 3:
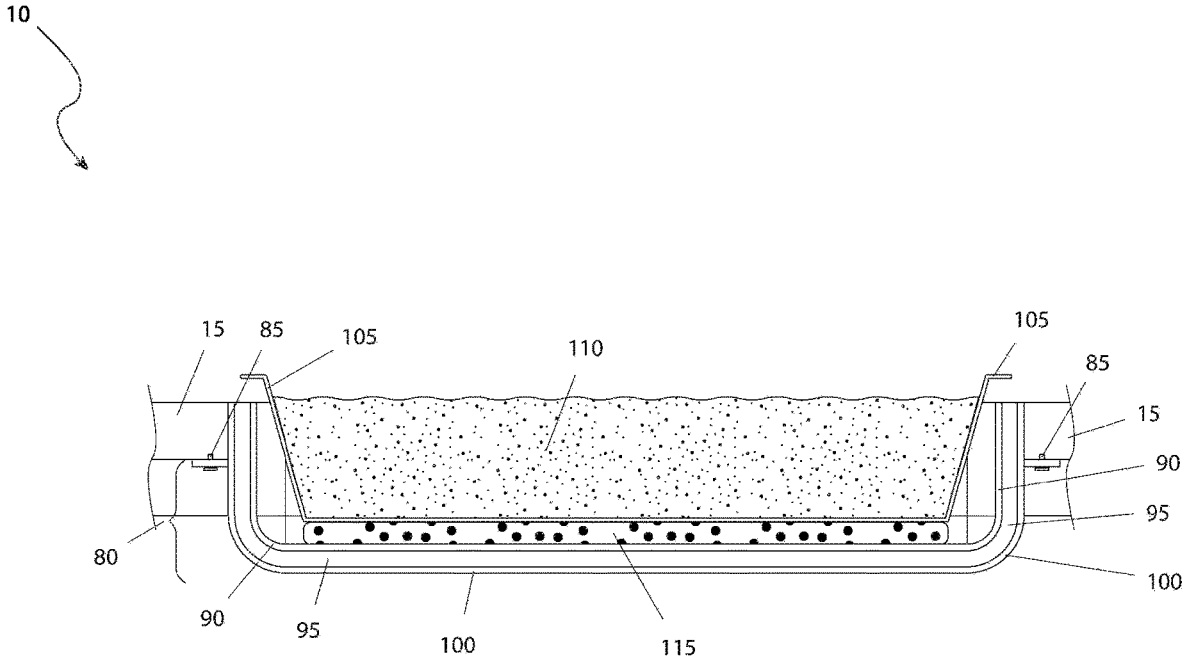
FIG. 3 is a sectional view of the portable serving table, as seen along a Line I-I, as shown in FIG. 1, according to the preferred embodiment of the present invention.

Referring now to FIG. 3, a sectional view of the table 10, as seen along a Line I-I, as shown in FIG. 1, according to the preferred embodiment of the present invention is shown. The insulating textile bags 80 is attached to the underside of the main table surface 15 by a series of fasteners 85 such as screws. The removable nature of the fasteners 85 allows for the insulating textile bags 80 to be removed, washed, cleaned, or replaced over the useful lifetime of the table 10. Each surface of the insulating textile bags 80 is envisioned to include an inner layer 90, an insulating layer 95, and an outer layer 100. The inner layer 90 would be of a waterproof nature such as nylon, rubber, or the like. The insulating layer 95 would be of thermally insulating nature such as cotton, spun fiber, wool, or the like. It would be capable of accepting a warm or cool temperature on a first side with an opposite cool or warm temperature on a second side. The outer layer 100 would be of a durable material capable of accepting repeated physical contact without damage such as nylon, canvas, or the like. A food serving dish 105 is placed in the insulating textile bags 80 such that the upper edge of the food serving dish 105 is approximately flush with the upper surface of the main table surface 15. The food serving dish 105 may be made of various materials such as aluminum foil, steel, copper, glass, ceramic, plastic, or the like and would generally be slightly smaller than the openings 60. For purposes of illustration, assuming that the food serving dish 105 contains a plurality of chilled foodstuffs 110, a plurality of chilled food, an ice pack 115 may be placed underneath the food serving dish 105 and within the insulating textile bags 80 to assist in keeping the chilled foodstuffs 110 at a chilled (cold) temperature. Such temperature maintenance provides for the dual functionality of keeping the food at a safe temperature and preventing the growth of bacteria, as well as keeping the food at a temperature that provides for enhanced taste. Foods that are served at a warmed temperature in a food serving dish 105 would rely solely on the insulating property of the insulating textile bags 80 for temperature maintenance. It is also noted that self-contained vessels such as beverage cans or bottles, single-serving yogurt cups, and the like, can be placed directly on the ice pack 115 without the use of a food serving dish 105.

Figure 4:
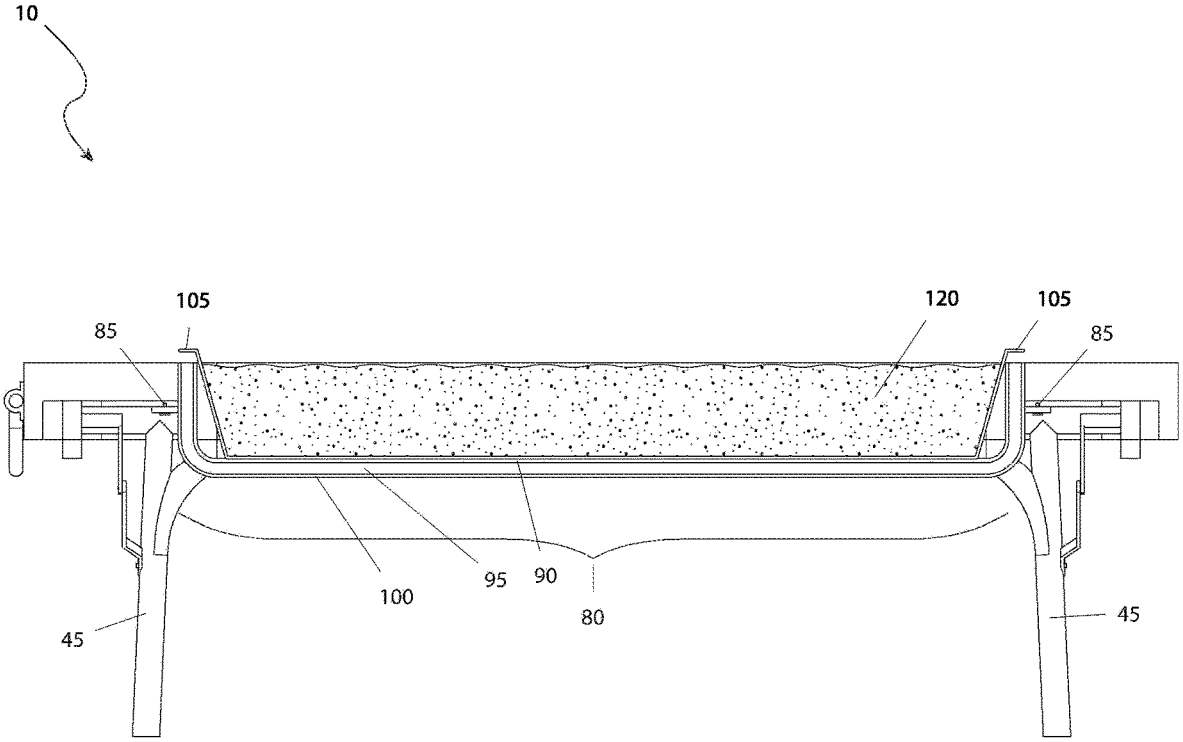
FIG. 4 is a sectional view of the portable serving table, as seen along a Line II-II, as shown in FIG. 1, according to the preferred embodiment of the present invention.

Referring next to FIG. 4, a sectional view of the table 10, as seen along a Line II-II, as shown in FIG. 1, according to the preferred embodiment of the present invention is disclosed. This view further clarifies the insulating textile bags 80 and its inner layer 90, its insulating layer 95, and its outer layer 100. The fasteners 85 are also visible in their fastening role. For purposes of illustration, the food serving dish 105 as depicted in FIG. 4, is envisioned to contain warmed foodstuffs 120. As aforementioned described, the intrinsic heat released from the warmed foodstuffs 120 through the food serving dish 105 is held captive primarily by the insulating layer 95 and as such, the warmed foodstuffs 120 retains its warmer temperature for a longer period of time than a similar food serving dish 105 with similar warmed foodstuffs 120 that is not placed within the insulating textile bags 80 of the table 10. The two (2) legs 45 are shown for reference on either side of the insulating textile bags 80.

Figure 5:
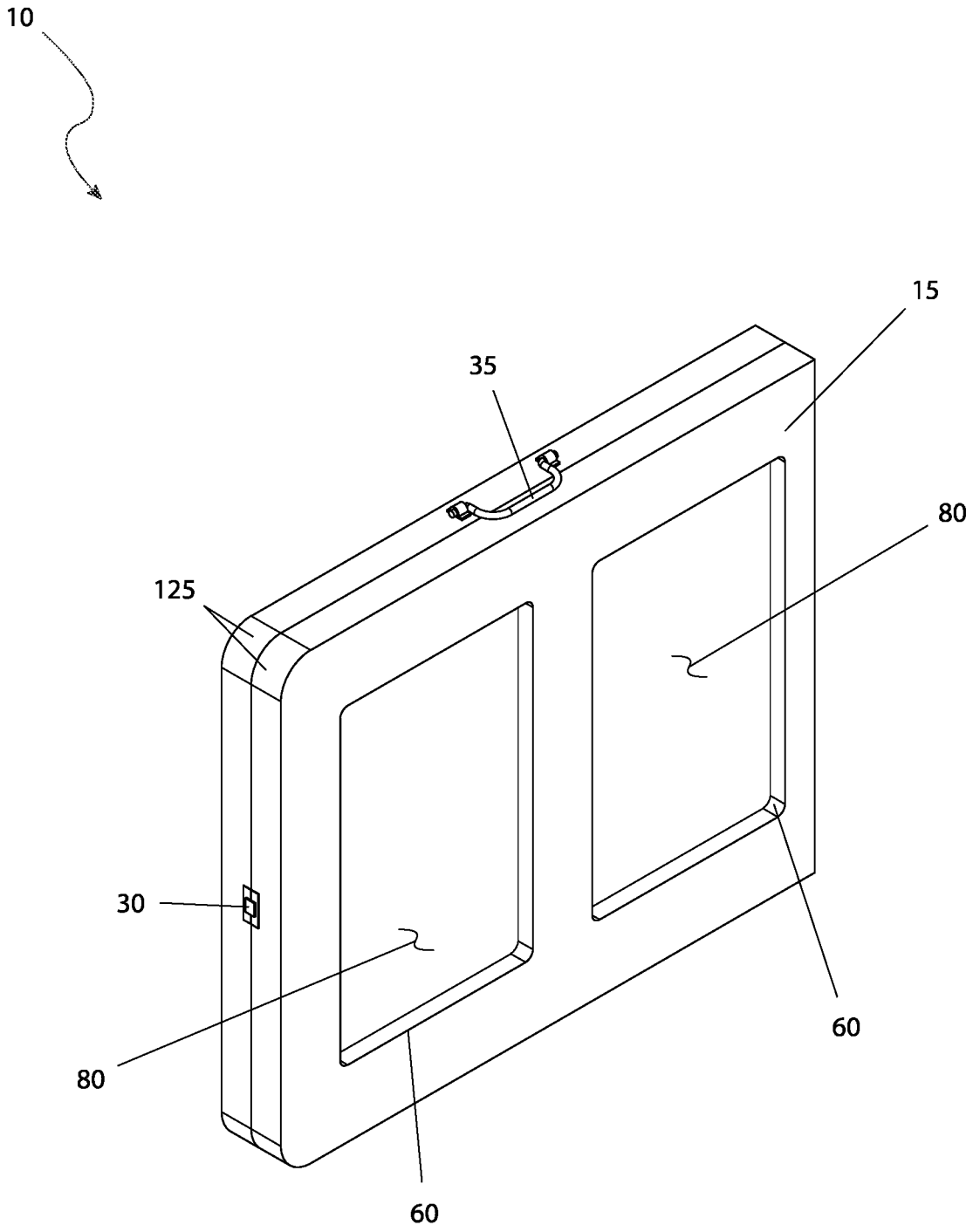
FIG. 5 is a perspective view of the portable serving table, in a stored state, according to the preferred embodiment of the present invention.

Referring to FIG. 5, a perspective view of the table 10, in a stored state, according to the preferred embodiment of the present invention is depicted. The main table surface 15 is folded along the center hinge 25 into two (2) table surface halves 125 and secured with the clasp 30. The handle 35 remains on top to facilitate carrying the table 10. Two (2) of the openings 60 remain visible with the insulating textile bags 80 in a compressed state inside. This configuration allows for easy transport in a motor vehicle or storage in a compact location such as a closet when the table 10 is not in use.

2. Operation of the Preferred Embodiment

The preferred embodiment of the present invention can be utilized by the common user in a simple and effortless manner with little or no training. It is envisioned that the table 10 would be constructed in general accordance with FIG. 1 through FIG. 5. The user would procure the table 10 from conventional procurement channels such as department stores, discount stores, wholesale clubs, food catering distributors, mail order and internet supply houses and the like.

After procurement and prior to utilization, the table 10 would be prepared in the following manner: the user would deploy the table surface halves 125 about the center hinge 25; the folding leg assemblies 40 would be motioned about the leg travel path "a" 55 such that both are perpendicular to the main table surface 15; the legs 45 would be secured via the locking braces 50; any openings 60 that are to contain chilled foodstuffs 110, would be provided with an ice pack 115 that is inserted in the insulating textile bags 80; various food serving dish 105 containing chilled foodstuffs 110 would be inserted into the insulating textile bags 80 previously provided with the ice pack 115; food serving dish 105 containing warmed foodstuffs 120 would be inserted into the insulating textile bags 80 singularly. At this point in time, the table 10 is ready for utilization.

During utilization of the table 10, the following procedure would be initiated: chilled foodstuffs 110 or warmed foodstuffs 120 would be served from the food serving dish 105 in a conventional manner; preferably in a buffet style, or as served by servers; as a first food serving dish 105 becomes empty, it may be replaced with other subsequent food serving dishes 105 as required; should the ice pack 115 become melted or otherwise depleted, said ice pack 115 can be replaced as needed. Said operation continues in a cyclical manner until the food serving process is completed. Should the services of the openings 60 and insulating textile bags 80 not be required, and the user wishes for a standard folding table, the table cover 65 may be placed over the main table surface 15 following the cover placement travel path "b" 70.

After use of the table 10, any food serving dish 105 and ice pack 115 are removed, the folding leg assemblies 40 are retracted along the leg travel path "a" 55, the main table surface 15 folded into two (2) table surface halves 125 and secured via the clasp 30. At this point in time, the table 10 may be transported or stored, until its services are once again required.

The features of the table 10 are envisioned to be especially beneficial for caterers, at large outdoor or indoor parties, backyard gatherings, camping excursions, formal or casual dining events, emergency events where large quantities of displaced people require feeding, and the like.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A portable serving table, comprising:

a main table surface having at least 4 openings adapted to accept a plurality of food serving devices and an upper edge;

at least one insulating textile bag disposed underneath each of the at least 4 openings positioned below the main table surface, the at least one insulating textile bag includes an inner layer, an insulating layer, and an outer layer;

a food serving dish placed in each of the at least one insulating textile bag such that the upper edge of the food serving dish is flush with an upper surface of the main table surface;

a center hinge disposed on a middle portion of the main table surface, the center hinge includes a clasp and a handle to facilitate storage and transport;

a pair of folding leg assemblies each having a pair of legs and a pair of locking braces; and a table cover covering the main table surface along a cover placement travel path.

2. The portable serving table, according to claim 1, wherein the upper edge of the food serving devices are flush with the main table surface.

3. The portable serving table, according to claim 1, wherein a pair of the at least 4 openings remain visible when the at least one insulating textile bag is in a compressed state.

4. The portable serving table, according to claim 1, wherein the main table surface is 6 feet in length.

5. The portable serving table, according to claim 1, wherein the at least one insulating textile bag allows the at least one insulating textile bag to be folded withing a cavity formed by the main table surface when the portable serving table is collapsed.

6. The portable serving table, according to claim 1, wherein the at least one insulating textile bag is attached underneath the main table surface by a plurality of fasteners.

7. The portable serving table, according to claim 6, wherein the fasteners are a plurality of removable screws.

8. The portable serving table, according to claim 7, wherein the removable screws allow for the at least one insulating textile bag to be removed, washed, cleaned, or replaced.

9. The portable serving table, according to claim 1, wherein the inner layer is selected from the group consisting of a nylon layer, a rubber layer, or a waterproof layer.

10. The portable serving table, according to claim 1, wherein the insulating layer accepts a warm temperature or a cool temperature on a first side of the insulating layer with an opposite cool temperature or a warm temperature on a second side of the insulating layer.

11. The portable serving table, according to claim 1, wherein the insulating layer is a thermally insulating layer selected from the group consisting of a cotton layer, a spun fiber layer, or a wool layer.

12. The portable serving table, according to claim 1, wherein the outer layer is made of a material capable of accepting repeated physical contact selected from the group consisting of a nylon material, a canvas material, or a durable material.

13. The portable serving table, according to claim 1, wherein the food serving dish is made of a material selected from the group consisting of aluminum foil, steel, copper, glass, ceramic, or plastic.

14. The portable serving table, according to claim 1, wherein the main table surface is folded along the center hinge into a pair of table surface halves that is secured with the clasp.

15. The portable serving table, according to claim 1, wherein the handle is disposed on top of the main table surface.

16. The portable serving table, according to claim 1, wherein the pair of folding leg assemblies move along a leg travel path to allow transfer from a stowed position within the main table surface to an extended position.

17. The portable serving table, according to claim 1, wherein the table cover transform the portable serving table into a conventional folding table with a continuous surface that covers the at least 4 openings.

18. The portable serving table, according to claim 1, wherein the table cover covers the main table surface when functionality and services of the portable serving table with the at least 4 openings are not required.

19. The portable serving table, according to claim 1, wherein the portable serving table facilitates serving one or more chilled foodstuffs.

20. The portable serving table, according to claim 1, wherein the portable serving table facilitates serving one or more warmed foodstuffs.

* * * * *